US009122243B2

(12) United States Patent
Miyaji

(10) Patent No.: US 9,122,243 B2
(45) Date of Patent: Sep. 1, 2015

(54) IMAGE FORMING APPARATUS

(71) Applicant: KYOCERA DOCUMENT SOLUTIONS INC., Osaka (JP)

(72) Inventor: Shinki Miyaji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/083,155

(22) Filed: Nov. 18, 2013

(65) Prior Publication Data

US 2014/0140713 A1 May 22, 2014

(30) Foreign Application Priority Data

Nov. 19, 2012 (JP) ..... 2012-253251

(51) Int. Cl.
*G03G 21/20* (2006.01)
*G03G 21/00* (2006.01)

(52) U.S. Cl.
CPC ..... *G03G 21/206* (2013.01); *G03G 21/0094* (2013.01)

(58) Field of Classification Search
USPC ..... 399/44
See application file for complete search history.

(56) References Cited

U.S. PATENT DOCUMENTS

| | | | | |
|---|---|---|---|---|
| 7,756,439 | B2 * | 7/2010 | Kosuge et al. | 399/100 |
| 7,899,352 | B2 | 3/2011 | Tomiie et al. | |
| 2006/0110172 | A1 * | 5/2006 | Iijima et al. | 399/44 |
| 2008/0101804 | A1 * | 5/2008 | Yoda et al. | 399/21 |
| 2008/0304853 | A1 * | 12/2008 | Tomiie et al. | 399/89 |
| 2010/0073417 | A1 * | 3/2010 | Li et al. | 347/17 |
| 2010/0135700 | A1 * | 6/2010 | Mutoh et al. | 399/254 |
| 2012/0189330 | A1 * | 7/2012 | Kunimatsu et al. | 399/44 |
| 2013/0243462 | A1 * | 9/2013 | Ono et al. | 399/66 |

FOREIGN PATENT DOCUMENTS

| | | | |
|---|---|---|---|
| JP | H08-335025 | A | 12/1996 |
| JP | 2002-351134 | A | 12/2002 |
| JP | 2005-300475 | A | 10/2005 |
| JP | 2008-216750 | A | 9/2008 |

OTHER PUBLICATIONS

An Office Action; Notice of Reasons for Rejection, issued by the Japanese Patent Office on Nov. 25, 2014, which corresponds to Japanese Patent Application No. 2012-253251 and is related to U.S. Appl. No. 14/083,155.

* cited by examiner

*Primary Examiner* — W B Perkey
*Assistant Examiner* — Linda B Smith
(74) *Attorney, Agent, or Firm* — Studebaker & Brackett PC

(57) ABSTRACT

An image forming apparatus includes an image carrier, a charging member, a transferring member, a first voltage applying part, a current measuring part, a fan, a cleaning member and a controlling part.

The controlling part carries out an aging operation rotating the image carrier and bringing the cleaning member in sliding contact with the image carrier before forming an image. The controlling part lengthens a running time of the aging operation in a case where a current value measured by the current measuring part is equal to or less than a first threshold value when the fan blows an outside air to the image carrier and the first voltage applying part applies voltage to one of the charging member and transferring member, in comparison with another case where the current value measured by the current measuring part exceeds the first threshold value.

9 Claims, 6 Drawing Sheets

IMAGE FORMING APPARATUS

INCORPORATION BY REFERENCE

This application is based on and claims the benefit of priority from Japanese Patent application No. 2012-253251 filed on Nov. 19, 2012, the entire contents of which are incorporated herein by reference.

BACKGROUND

The present disclosure relates to an image forming apparatus, such as a printer, a copying machine, a facsimile or a multifunction peripheral, using electrographic process.

An image forming apparatus using electrographic process is configured so as to transfer a toner image carried on an image carrier (for example, a photosensitive drum) to a transferred body (for example, a recording medium, such as a sheet, or an intermediate transfer belt) by a transferring member (for example, a transferring roller). In the image forming apparatus configured by such a manner, in a case of applying an organic photoreceptor, particularly a monolayer organic photoreceptor having a charge generating agent and a charge transport agent in the same layer, as the image carrier, if image forming operation is carried out after the apparatus is stopped for a few hours, influence of a volatile substance contained in the transferring member on the image carrier may cause a lateral stripe on an image.

Such an image failure is easily caused in a case where temperature and humidity in the outside of the apparatus (the apparatus outside) are low, but avoided by carrying out aging operation rotating the image carrier and bringing a cleaning member in sliding contact with a surface of the image carrier before forming the image. However, in a configuration carrying out this aging operation for a predetermined period every time, the aging operation is carried out for the predetermined period even in a case where the lateral stripe is not inclined to be caused on the image (for example, a case where the temperature and humidity in the apparatus outside are high). According to this, a first print time (a time until a first print is completed) is unnecessarily lengthened, thereby applying a stress to a user. In order to avoid such a situation, it is considered that the aging operation is carried out for a necessary time on the basis of information from sensors detecting the temperature and humidity.

However, because a humidity sensor is a relatively expensive part, adaption of the humidity sensor causes increase in cost. Therefore, particularly in a low segment machine (a low price machine), it is difficult to meet request of further price reduction.

SUMMARY

In accordance with an embodiment of the present disclosure, an image forming apparatus includes an image carrier, a charging member, a transferring member, a first voltage applying part, a current measuring part, a fan, a cleaning member and a controlling part. The image carrier carries a toner image. The charging member electrically charges the image carrier. The transferring member transfers the toner image carried on the image carrier to a transferred body. The first voltage applying part applies voltage to one of the charging member and transferring member. The current measuring part measures current flowing when the first voltage applying part applies the voltage to the one of the charging member and transferring member. The fan introduces an outside air to the apparatus inside and blows the outside air to the image carrier. The cleaning member removes a toner from a surface of the image carrier. The controlling part carries out an aging operation rotating the image carrier and bringing the cleaning member in sliding contact with the surface of the image carrier before forming an image. The controlling part lengthens a running time of the aging operation in a case where the current value measured by the current measuring part is equal to or less than a first threshold value when the fan blows the outside air to the image carrier and the first voltage applying part applies the voltage to the one of the charging member and transferring member, in comparison with another case where the current value measured by the current measuring part exceeds the first threshold value.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
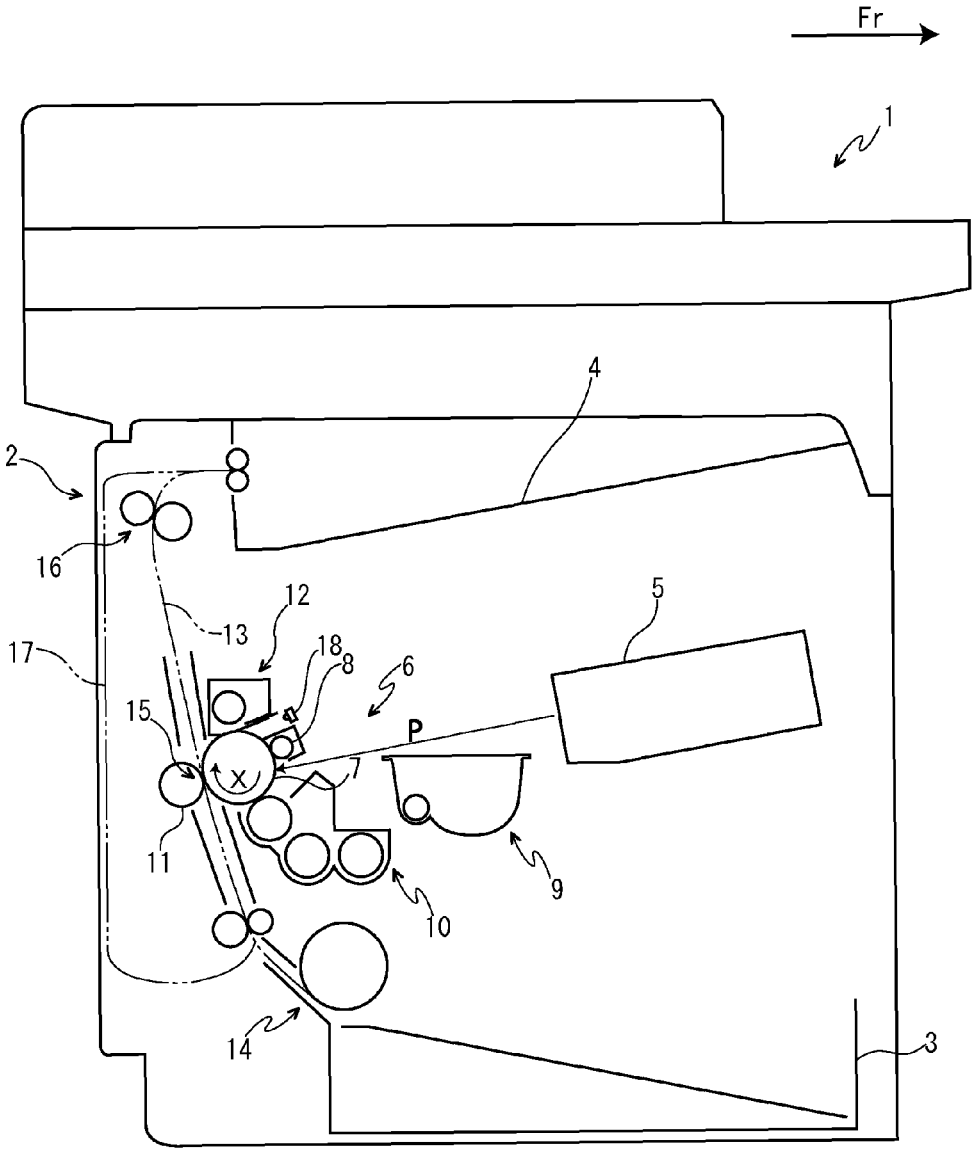
FIG. 1 is a schematic diagram schematically showing a printer according to an embodiment of the present disclosure.

First, with reference to FIG. 1, the schematic structure of a printer 1 as an image forming apparatus will be described. FIG. 1 is a schematic diagram schematically showing the printer according to an embodiment of the present disclosure. Hereinafter, it will be described so that the front side of the printer 1 is positioned at the right-hand side of FIG. 1. Arrows Fr in FIGS. 1-3 indicate the front side of the printer 1.

The printer 1 includes a printer main body 2. In a lower part of the printer main body 2, a sheet feeding cartridge 3 storing sheets (not shown) as a transferred body is installed and, in a top end of the printer main body 2, a sheet ejecting tray 4 is formed.

In a front part of the printer main body 2, an exposure device 5 composed of a laser scanning unit (LSU) is installed and, in a rear part of the printer main body 2, an image forming unit 6 is arranged. In the image forming unit 6, a photosensitive drum 7 as an image carrier is rotatably installed. Around the photosensitive drum 7, a charging roller 8 as a charging member, a development device 10 connected to a toner container 9, a transferring roller 11 as a transferring member, a cleaning device 12 and a discharging lamp 18 are located along a rotating direction (refer to an arrow X in FIG. 1) of the photosensitive drum 7.

In the rear part of the printer main body 2, a sheet conveying path 13 is arranged from a lower side to an upper side.

That is, the printer 1 applies a vertical conveying system conveying the sheet from the lower side to the upper side. At an upstream end in the conveying path 13, a sheet feeder 14 is positioned. At an intermediate stream part in the conveying path 13, a transferring unit 15 composed of the photosensitive drum 7 and transferring roller 11 is positioned. At a downstream part in the conveying path 13, a fixing device 16 is positioned. In the rear of the conveying path 13, an inversion path 17 for duplex printing is arranged.

Next, the operation of forming an image by the printer 1 having such a configuration will be described.

When the power is supplied to the printer 1, various parameters are initialized and initial determination, such as temperature determination of the fixing device 16, is carried out. Subsequently, in the printer 1, when image data is inputted and a printing start is directed from a computer or the like connected with the printer 1, image forming operation is carried out as follows.

First, the surface of the photosensitive drum 7 is uniformly electric-charged by the charging roller 8. Then, exposure corresponding to the image data on the photosensitive drum 7 is carried out by a laser light (refer to an arrow P in FIG. 1) from the exposure device 5, thereby forming an electrostatic latent image on the surface of the photosensitive drum 7. Subsequently, the development device 10 develops the electrostatic latent image by a toner (a developer) supplied from the toner container 9. Accordingly, a toner image is carried on the photosensitive drum 7.

On the other hand, the sheet fed from the sheet feeding cartridge 3 by the sheet feeder 14 is conveyed to the transferring unit 15 in a suitable timing for the above-mentioned image forming operation. Then, the toner image carried on the photosensitive drum 7 is transferred onto the sheet by the transferring roller 11. The sheet with the transferred toner image is conveyed to a downstream side in the conveying path 13 to go forward to the fixing device 16, and then, the toner image is fixed on the sheet in the fixing device 16. The sheet with the fixed toner image is ejected from a downstream end in the conveying path 13 to the sheet ejecting tray 4. The toner and electrical charge remained on the photosensitive drum 7 is removed by the cleaning device 12 and discharging lamp 18.

Figure 2:
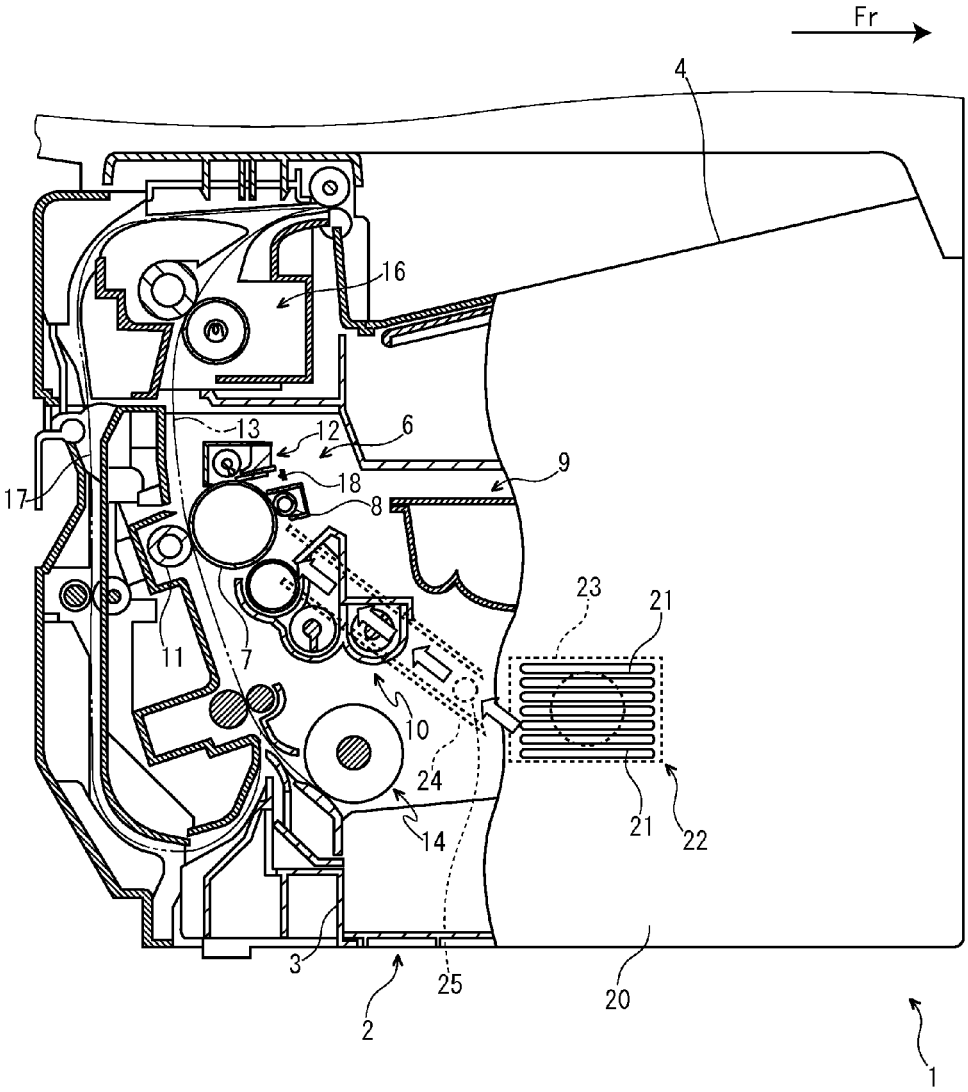
FIG. 2 is a partially cutaway sectional view showing a printer according to the embodiment of the present disclosure.

Next, with reference to FIGS. 2 and 3, the printer main body 2 and image forming part 6 will be described in more detail.

First, the printer main body 2 and its peripheral members will be described. As shown in FIG. 2, in a left end part (an end part at a near side in FIG. 2) of the printer main body 2, a left cover 20 is arranged so as to cover a left end part of the image forming part 6. In FIG. 2, the left cover 20 is illustrated so that a rear part is cut away. In a lower part of the left cover 20, a ventilation port 22 composed of a plurality of louvers is formed.

In the left end part of the printer main body 2, a fan 23 is installed inside (at a right side of) the ventilation port 22 of the left cover 20. The fan 23 is configured to introduce an outside air to the inside of the apparatus (the apparatus inside) during activating (rotating).

Inside the printer main body 2, a duct 24 is arranged. The duct 24 is configured to extend from the fan 23's side to the photosensitive drum 7's side and to guide the outside air introduced to the apparatus inside by the fan 23 to the photosensitive drum 7 (refer to a void arrow in FIG. 2). In an upstream end part (a nearest part to the fan 23) inside the duct 24, a temperature sensor 25 is arranged. The temperature sensor 25 is composed of, for example, a thermistor.

Next, the image forming part 6 will be described. The image forming part 6 is housed in the printer main body 2 and located between the fan 23 and fixing device 16 in aside view. As shown in FIG. 3, the image forming part 6 includes the photosensitive drum 7, charging roller 8 located in front of the photosensitive drum 7, development device 10 located at a lower forward side of the photosensitive drum 7, transferring roller 11 located in the rear of the photosensitive drum 7, cleaning device 12 located above the photosensitive drum 7 and discharging lamp 18 located at a upper forward side of the photosensitive drum 7.

Figure 3:
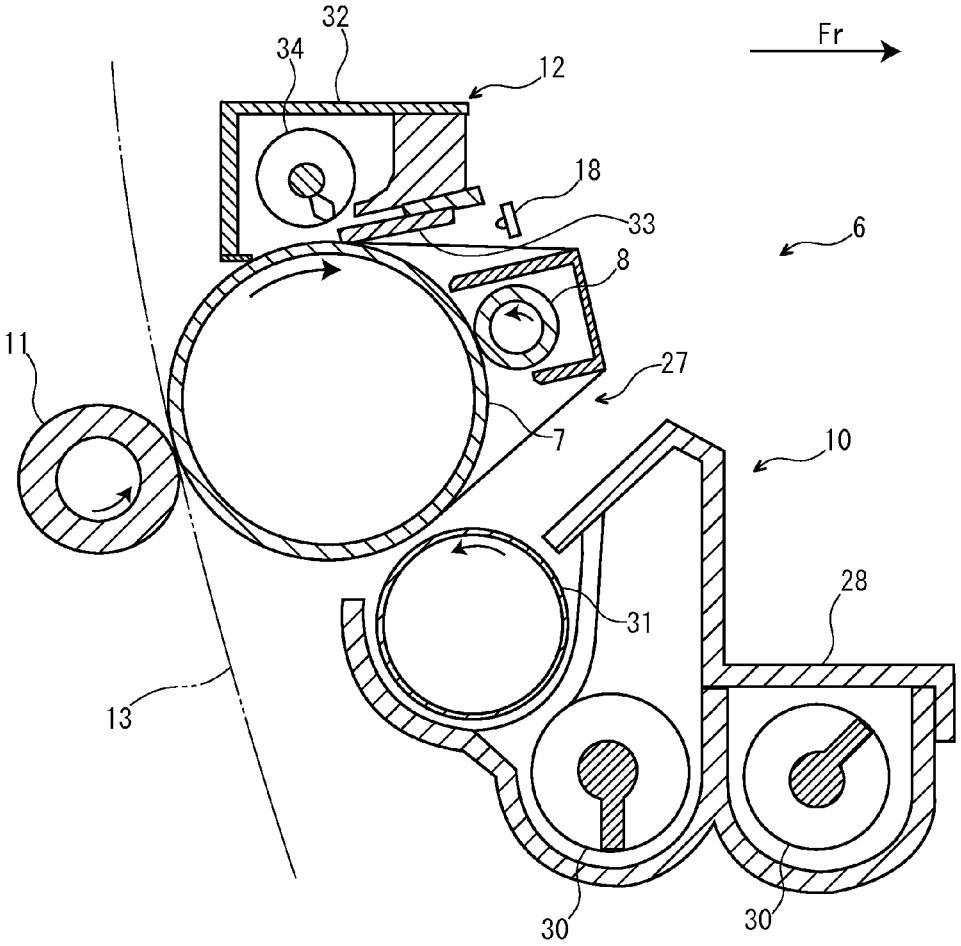
FIG. 3 is a sectional view showing an image forming part in the printer according to the embodiment of the present disclosure.

The photosensitive drum 7 is formed in an elongated shape in left and right directions (a depth direction in FIG. 3). The photosensitive drum 7 is composed of a monolayer organic photoreceptor containing a charge generating agent and a charge transport agent in the same layer. As the above-mentioned charge generating agent, for example, a phthalocyanine pigment, a perylene pigment, a bisazo pigment, a dithioketopyrrolopyrrole pigment, a metal-free naphthalocyanine pigment, a metal naphthalocyanine pigment, a squaraines pigment, a trisazo pigment, an indigo pigment, an azulenium pigment, a cyanine pigment, selenium, selenium-tellurium, amorphous silicon, pyrylium salt, an anthranthrone pigment, a triphenylmethane pigment, a threne pigment, a toluidine pigment, a pyrazoline pigment, a quinacridone pigment or the like may be applied. As the above-mentioned charge transport agent, for example, a nitrogen-containing cyclic compound, a condensed polycyclic compound or the like, such as a oxadiazole compound, a styryl compound, a carbazole compound, an organic polysilane compound, a pyrazoline compound, a hydrazone compound, a triphenylamine compound, an oxazole compound, an isoxazole compound, a triazole compound, a thiadiazole compound, an imidazole compound, a pyrazole compound or a triazole compound, may be applied.

The charging roller 8 is formed in an elongated shape in the left and right directions. The charging roller 8 is composed of, for example, a solid rubber roller consisting mainly of epichlorohydrin. The charging roller 8 comes into contact with the photosensitive drum 7. The charging roller 8 is integrated with the photosensitive drum 7 to compose a drum unit 27. The drum unit 27 is attachably/detachably attached to the printer main body 2.

The development device 10 includes a box-like formed development device main body 28, a pair of front and rear agitating members 30 housed in the development device main body 28, and a developing roller 31 as a developing member being located at an upper backward side of the rear agitating member 30 and facing to the photosensitive drum 7. Here, the toner supplied from the toner container 9 (refer to FIG. 1) is agitated by the agitating members 30, and then, supplied to the photosensitive drum 7 by the developing roller 31.

The transferring roller 11 is composed of, for example, a foamed rubber roller consisting mainly of epichlorohydrin. The transferring roller 11 comes into contact with the photosensitive drum 7.

The cleaning device 12 includes a box-like formed frame member 32, a cleaning blade 33 as a cleaning member supported by this frame member 32 and a collecting spiral 34 housed in the frame member 32. The collecting spiral 34 is connected to a toner collecting box (not shown) arranged outside the cleaning device 12. The toner removed from the surface of the photosensitive drum 7 by the cleaning blade 33 is collected by the collecting spiral 34 and conveyed to the toner collecting box.

The discharging lamp 18 is positioned at an upstream side of the charging roller 8 in the rotating direction of the photosensitive drum 7. The discharging lamp 18 is configured by arranging a plurality of emitting elements (e.g. red LEDs (Light Emitting Diodes)) in a line on a printed circuit board so as to irradiate the electric-discharging light from each emitting element onto the photosensitive drum 7, thereby electrically discharging surface potential of the photosensitive drum 7.

Figure 4:
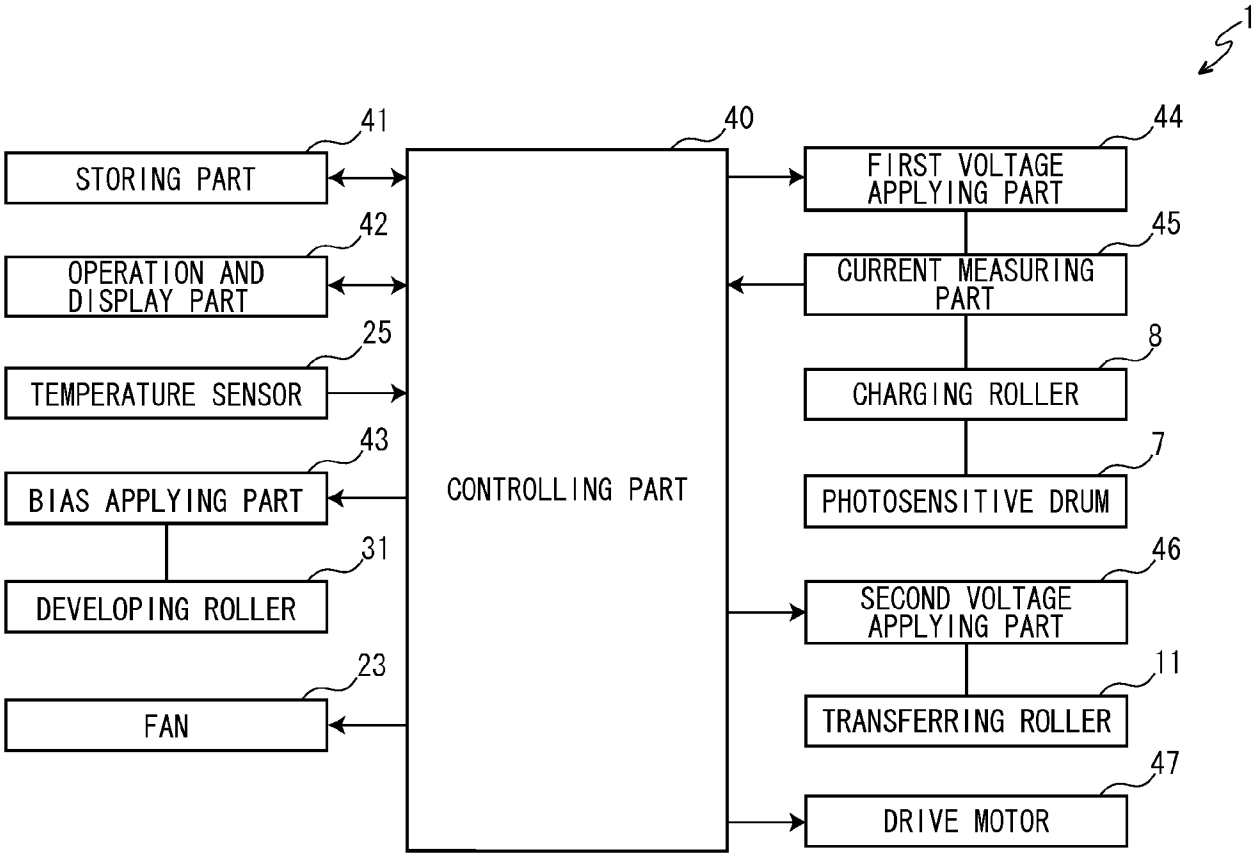
FIG. 4 is a schematic block diagram showing the structure of the printer according to the embodiment of the present disclosure.

Next, with reference to FIG. 4, a control system of the printer 1 will be described.

The printer 1 includes a controlling part (CPU: Central Processing Unit) 40. The controlling part 40 is connected to a storing part 41 composed of storage devices, such as a ROM (Read Only Memory) and a RAM (Random Access Memory). The controlling part 40 is configured so as to control each component of the printer 1 on the basis of control program and control data stored in the storing part 41. The storing part 41 stores a first threshold value $I_{th}$ (e.g. 2 μA) as a threshold value of current flowing into the charging roller 8 and a second threshold value $T_{th}$ (e.g. 23° C.) as a threshold value of temperature detected by the temperature sensor 25.

The controlling part 40 is connected to an operation and display part 42 arranged to the printer main body 2. The operation and display part 42 includes, for example, operation keys, such as a start key, a stop/clear key, a power key, numeric keys and a touch panel. The operation and display part 42 is configured so as to output the operation instruction to the controlling part 40 according to manipulation of each operation key by a user.

The controlling part 40 is connected to the temperature sensor 25. The temperature detected by the temperature sensor 25 is outputted to the controlling part 40.

The controlling part 40 is connected to a bias applying part 43 and the bias applying part 43 is connected to the developing roller 31. The controlling part 40 is configured so as to control bias applied from the bias applying part 43 to the developing roller 31.

The controlling part 40 is connected to the fan 23. The fan 23 is configured to rotate on the basis of a signal from the controlling part 40.

The controlling part 40 is connected to a first voltage applying part 44 and the first voltage applying part 44 is connected to the charging roller 8. The controlling part 40 is configured so as to control voltage applied from the first voltage applying part 44 to the charging roller 8. Between the first voltage applying part 44 and charging roller 8, a current measuring part 45 is connected in series. The current measuring part 45 is configured so as to measure current flowing from the first voltage applying part 44 to the charging roller 8 when the first voltage applying part 44 applies the voltage to the charging roller 8, and then, to output the measured result to the controlling part 40.

The controlling part 40 is also connected to a second voltage applying part 46 and the second voltage applying part 46 is connected to the transferring roller 11. The controlling part 40 is configured so as to control voltage applied from the second voltage applying part 46 to the transferring roller 11.

The controlling part 40 is connected to a drive motor 47. The drive motor 47 is connected to rotating members, such as the photosensitive drum 7, charging roller 8 and developing roller 31. The drive motor 47 is configured to rotate the above-mentioned rotating members on the basis of a signal from the controlling part 40.

Next, in the above-mentioned configuration, relationship between a flowing current value from the first voltage applying part 44 to the charging roller 8 (hereinafter, simply called as a "flowing current value") and temperature and humidity in the outside of the apparatus (the apparatus outside) will be described with reference to FIG. 5.

Figure 5:
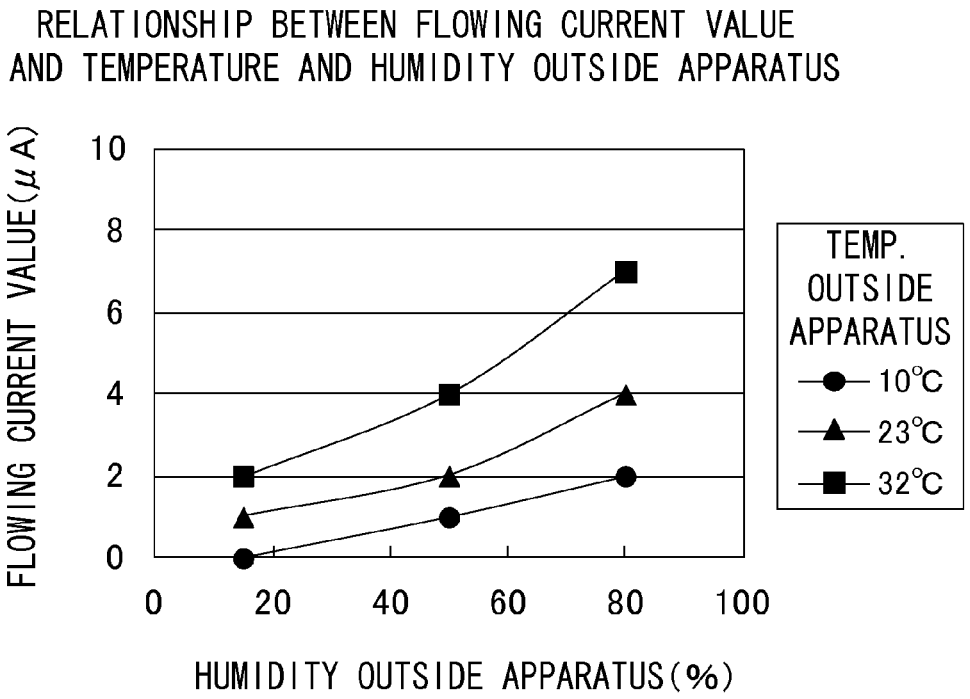
FIG. 5 is a graph showing relationship between a flowing current value to a charging roller and temperature and humidity outside an apparatus in the printer according to the embodiment of the present disclosure.

As shown in FIG. 5, the flowing current value increases, as the humidity in the apparatus outside gets higher. This shows that in one case where the flowing current value is equal to or less than a predetermined threshold value, in comparison with another case where the flowing current value exceeds the predetermined threshold value, the humidity in the apparatus outside is lower and an image failure, such as a lateral stripe on an image, is easily caused. In addition, this shows that in the other case where the flowing current value exceeds the predetermined threshold value, in comparison with the one case where the flowing current value is equal to or less than the predetermined threshold value, the humidity in the apparatus outside gets higher and the image failure, such as the lateral stripe on the image, is not inclined to be caused. Moreover, FIG. 5 shows that the flowing current value increases, as the temperature in the apparatus outside gets higher.

Figure 6:
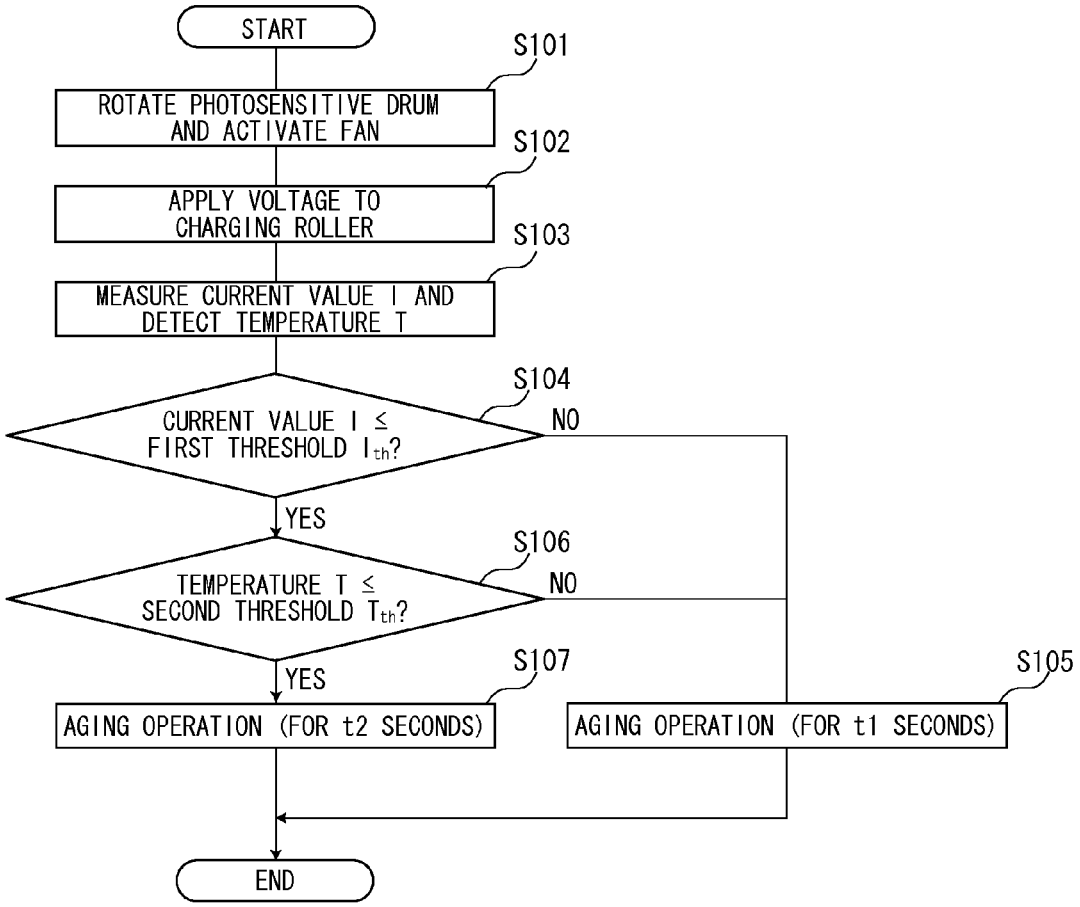
FIG. 6 is a flowchart showing aging control in the printer according to the embodiment of the present disclosure.

Next, in the above-mentioned configuration, aging control carried out before forming the image will be described mainly with reference to FIGS. 6 and 2.

First, when the printer 1 is activated, the photosensitive drum 7 is rotated and the fan 23 is activated (step S101). By this activation of the fan 23, the outside air is introduced to the apparatus inside and blown to the temperature sensor 25 arranged inside the duct 24 as indicated by the void arrow in FIG. 2. The outside air flowing inside the duct 24 flows from the fan 23's side to the photosensitive drum 7's side inside the duct 24 as indicated by the void arrow in FIG. 2, and then, is blown to the photosensitive drum 7.

After a predetermined period (e.g. 5 seconds) is elapsed from the activation of the fan 23 and the outside air introduced to the apparatus inside by the fan 23 is blown to the temperature sensor 25 and photosensitive drum 7 as mentioned above, the first voltage applying part 44 applies predetermined voltage (e.g. 1250V) to the charging roller 8 (step S102). At this time, the current measuring part 45 measures the current value I flowing into the charging roller 8 and the temperature sensor 25 detects the temperature T of the outside air introduced by the fan 23 (step S103).

Subsequently, the controlling part 40 decides whether or not the current value I measured by the current measuring part 45 is equal to or less than the first threshold value $I_{th}$ stored in the storing part 41 (step S104). If the decision result of step S104 is NO, the controlling part 40 carries out an aging operation for t1 seconds (e.g. 5 seconds) (step S105). In this aging operation, the photosensitive drum 7 is rotated and the cleaning blade 33 is brought in sliding contact with the surface of the photosensitive drum 7. According to this, influence of a volatile substance contained in the transferring roller 11 on the photosensitive drum 7 is relieved to restrain the image failure, such as the lateral stripe on the image, from being caused, thereby obtaining an excellent outputted image.

On the other hand, if the decision result of step S104 is YES, the controlling part 40 decides whether or not the temperature T detected by the temperature sensor 25 is equal to or less than the second threshold value $T_{th}$ stored in the storing part 41 (step S106). If the decision result of step S106 is NO, the controlling part 40 carries out the aging operation for t1 seconds (step S105).

On the other hand, if the decision result of step S106 is YES, the controlling part 40 carries out this aging operation for t2 seconds (e.g. 30 seconds) longer than the above-mentioned t1 seconds (step S107).

In the embodiment, as described above, when the fan 23 blows the outside air to the photosensitive drum 7 and the first voltage applying part 44 applies predetermined voltage to the charging roller 8, in a case where the current value I measured by the current measuring part 45 is equal to or less than the first threshold value $I_{th}$, a running time of the aging operation is lengthened in comparison with another case where the current value I measured by the current measuring part 45 exceeds the first threshold value $I_{th}$. By applying such a configuration, it is possible to suitably determine the running time of the aging operation without using the humidity sensor and to restrain the image failure, such as the lateral stripe on the image, from being caused. Therefore, it is possible to decrease cost in comparison with a case where the running time of the aging operation is determined by using the humidity sensor, and then, to meet request of further price reduction in a low segment machine.

If the humidity in the apparatus outside is equal to or less than a predetermined value and the image failure, such as the lateral stripe on the image, is easily caused, the aging operation is carried out for a longer time than a case where the humidity in the apparatus outside exceeds the predetermined value. According to this, it is possible to certainly prevent the image failure, such as the lateral stripe on the image, from being caused. On the other hand, if the humidity in the apparatus outside exceeds the predetermined value and the image failure, such as the lateral stripe on the image, is not inclined to be caused, the aging operation is shortened in comparison with another case where the humidity in the apparatus outside is equal to or less than the predetermined value. According to this, it is possible to shorten a first print time and to reduce a stress of the user.

In the embodiment, as mentioned above, when the fan 23 blows the outside air to the temperature sensor 25, in a case where the temperature T detected by the temperature sensor 25 is equal to or less than the second threshold value $T_{th}$, the running time of the aging operation is lengthened in comparison with another case where the temperature T detected by the temperature sensor 24 exceeds the second threshold value $T_{th}$. By applying such a configuration, it is possible to more suitably determine the running time of the aging operation in comparison with a case where the running time of the aging operation is determined on the basis of the current value I measured by the current measuring part 45.

If the temperature in the apparatus outside is equal to or less than a predetermined value and the image failure, such as the lateral stripe on the image, is easily caused, the aging operation is carried out for a longer time than a case where the temperature in the apparatus outside exceeds the predetermined value. According to this, it is possible to certainly prevent the image failure, such as the lateral stripe on the image, from being caused. On the other hand, if the temperature in the apparatus outside exceeds the predetermined value and the image failure, such as the lateral stripe on the image, is not inclined to be caused, the aging operation is shortened in comparison with another case where the temperature in the apparatus outside is equal to or less than the predetermined value. According to this, it is possible to shorten the first print time and to reduce the stress of the user.

The temperature sensor 25 is arranged inside the duct 24 extending from the fan 23's side to the photosensitive drum 7's side. Therefore, it is possible to certainly blow the outside air introduced to the apparatus inside by the fan 23 to the temperature sensor 25, and accordingly, to accurately detect the temperature of the outside air by the temperature sensor 25.

The photosensitive drum 7 is composed of the monolayer organic photoreceptor containing the charge generating agent and charge transport agent in the same layer. Therefore, in comparison with a case where the photosensitive drum 7 is composed of a laminated organic photoreceptor, the current value I measured by the current measuring part 45 significantly varies in accordance with variation of the humidity in the apparatus outside. That facilitates a grasp of the humidity in the apparatus outside.

Incidentally, in the above-mentioned case of applying the monolayer photoreceptor containing the charge generating agent and charge transport agent in the same layer as the photosensitive drum 7, charging efficiency and transferring efficiency significantly varies in accordance with the humidity in the apparatus outside. Then, in the embodiment, on the basis of the current value I measured by the current measuring part 45 when the fan 23 blows the outside air to the photosensitive drum 7 and the first voltage applying part 44 applies the predetermined voltage to the charging roller 8, the voltage applied to the charging roller 8 by the first voltage applying part 44 and the voltage applied to the transferring roller 11 by the second voltage applying part 46 for forming the image are determined. Concretely, when the fan 23 blows the outside air to the photosensitive drum 7 and the first voltage applying part 44 applies the predetermined voltage to the charging roller 8, in a case where the current value I measured by the current measuring part 45 is equal to or less than a first standard value $I_{S1}$ (e.g. 2 μA), in comparison with another case where the above-mentioned current value I exceeds the first standard value $I_{S1}$, the voltage applied to the charging roller 8 by the first voltage applying part 44 is increased and the voltage applied to the transferring roller 11 by the second voltage applying part 46 is decreased.

By applying such a configuration, it is possible to apply the most suitable voltage for the humidity in the apparatus outside from the first voltage applying part 44 to the charging roller 8 and to apply the most suitable voltage for the humidity in the apparatus outside from the second voltage applying part 46 to the transferring roller 11. Therefore, it is possible to enhance quality of the outputted image. In addition, because the voltage applied to the charging roller 8 by the first voltage applying part 44 and the voltage applied to the transferring roller 11 by the second voltage applying part 46 are determined on the basis of the humidity in the apparatus outside, it is unnecessary to install a ROM storing these voltages to the drum unit 27. In this regard, it is possible to decrease the cost.

In the embodiment, on the basis of the current value I measured by the current measuring part 45 when the fan 23 blows the outside air to the photosensitive drum 7 and the first voltage applying part 44 applies the predetermined voltage to the charging roller 8, the bias (AC (Alternating Current) bias) applied to the developing roller 31 by the bias applying part 43 is determined. Concretely, when the fan 23 blows the outside air to the photosensitive drum 7 and the first voltage applying part 44 applies the predetermined voltage to the charging roller 8, in a case where the current value I measured by the current measuring part 45 is equal to or less than a second standard value $I_{S2}$ (e.g. 2 μA), in comparison with another case where the above-mentioned current value I exceeds the second standard value $I_{S2}$ a duty ratio of the bias applied to the developing roller 31 by the bias applying part 43 is increased. By applying such a configuration, it is possible to apply the most suitable bias for the humidity in the apparatus outside from the bias applying part 43 to the developing roller 31, and then, to enhance the quality of the outputted image.

The embodiment was described about an example of lengthening the running time of the aging operation in a case where the current value I measured by the current measuring part 45 is equal to or less than the first threshold value $I_{th}$ stored in the storing part 41 and the temperature T detected by the temperature sensor 25 is equal to or less than the second threshold value $T_{th}$ stored in the storing part 41, in comparison with another case where the current value I measured by the current measuring part 45 exceeds the first threshold value $I_{th}$ stored in the storing part 41 or another case where the temperature T detected by the temperature sensor 25 exceeds the second threshold value $T_{th}$ stored in the storing part 41. On the other hand, in another embodiment, the running time of the aging operation in a case where the current value I measured by the current measuring part 45 is equal to or less than the first threshold value $T_{th}$ stored in the storing part 41 or a case where the temperature T detected by the temperature sensor 25 is equal to or less than the second threshold value $T_{th}$ stored in the storing part 41 may be lengthened in comparison with another case where the current value I measured by the current measuring part 45 exceeds the first threshold value $I_{th}$ stored in the storing part 41 and the temperature T detected by the temperature sensor 25 exceeds the second threshold value $T_{th}$ stored in the storing part 41. That is, a condition that the current value I measured by the current measuring part 45 is equal to or less than the first threshold value $I_{th}$ stored in the storing part 41 and a condition that the temperature T detected by the temperature sensor 25 is equal to or less than the second threshold value $T_{th}$ stored in the storing part 41 may be set as AND condition, or alternatively, set as OR condition.

Although the embodiment was described about a case of applying the predetermined voltage from the first voltage applying part 44 to the charging roller 8 in the aging operation, in another embodiment, the second voltage applying part 46 may apply the predetermined voltage to the transferring roller 11 in the aging operation.

In the embodiment, when the fan 23 blows the outside air to the photosensitive drum 7 and the first voltage applying part 44 applies the predetermined voltage to the charging roller 8, the current flowing to the charging roller 8 is measured by the current measuring part 45. On the other hand, in another embodiment, when the fan 23 blows the outside air to the photosensitive drum 7 and the first voltage applying part 44 applies the predetermined voltage to the charging roller 8, current flowing to the transferring roller 11 or current flowing to the photosensitive drum 7 may be measured.

The embodiment was described about a case of rotating the photosensitive drum 7 and bringing the cleaning blade 33 in sliding contact with the surface of the photosensitive drum 7 as the aging operation. On the other hand, in another embodiment, during the aging operation, in addition to the sliding contact of the cleaning blade 33 with the photosensitive drum 7, the developing roller 31 may supply the toner to the photosensitive drum 7 or the first voltage applying part 44 may apply the voltage to the charging roller 8. By applying such a configuration, in some cases, it is possible to more effectively relieve the influence of the volatile substance contained in the transferring roller 11 on the photosensitive drum 7, and then, to shorten a necessary time of the aging operation.

Although, in the embodiment, one first threshold value $I_{th}$ and one second threshold value $T_{th}$ are set, in another embodiment, a plurality of first threshold values $I_{th}$ and a plurality of second threshold values $T_{th}$ may be set. In other words, although the embodiment was described about a case of switching the running time of the aging operation between the times t1 and t2 in two steps, in the other embodiment, the running time of the aging operation may be switched in three or more steps, i.e. multi steps. By applying such a configuration, it is possible to carry out the minimum required aging operation in accordance with the temperature and humidity in the apparatus outside, and then, to further shorten the first print time and to further reduce the stress of the user. Moreover, in a further embodiment, the running time of the aging operation may be set to zero when the current value I is equal to or less than the first threshold value $I_{th}$ or the temperature T is equal to or less than the second threshold value $T_{th}$.

Although the embodiment was described about a case of applying the charging roller 8 as the charging member, in another embodiment, the charging member having another shape, such as a charging brush, may be applied.

Although the embodiment was described about a case of arranging the temperature sensor 25 inside the duct 24, in another embodiment, the temperature sensor 25 may be arranged outside the duct 24.

Although the embodiment was described about a case of applying the sheet as the transferred body, in another embodiment applying a tandem image forming apparatus, an intermediate transfer belt may be applied as the transferred body.

Although the embodiment was described in a case where the configuration of the present disclosure are applied to the printer 1, another embodiment may apply the configuration of the disclosure to another image forming apparatus except the printer 1, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an image carrier carrying a toner image;

a charging member electrically charging the image carrier;

a transferring member transferring the toner image carried on the image carrier to a transferred body;

a first voltage applying part applying voltage to one of the charging member and transferring member;

a current measuring part measuring current flowing from the first voltage applying part to the charging member when the first voltage applying part applies the voltage to the one of the charging member and transferring member, the current measuring part measuring the current value increasing as humidity and temperature of the apparatus outside gets higher;

a fan introducing an outside air to the apparatus inside and blowing the outside air to the image carrier;

a cleaning member removing a toner from a surface of the image carrier; and a controlling part configured to carry out an aging operation rotating the image carrier and bringing the cleaning member in sliding contact with the surface of the image carrier before forming an image and to lengthen a running time of the aging operation in a case where the current value measured by the current measuring part is equal to or less than a first threshold value when the fan blows the outside air to the image carrier and the first voltage applying part applies the voltage to the one of the charging member and transferring member, in comparison with another case where the current value measured by the current measuring part exceeds the first threshold value.

2. The image forming apparatus according to claim 1 further comprising:

a temperature sensor to which the outside air introduced to the apparatus inside by the fan is blown, wherein the controlling part lengthens the running time of the aging operation in a case where temperature detected by the temperature sensor is equal to or less than a second threshold value when the fan blows the outside air to the temperature sensor, in comparison with another case where the temperature detected by the temperature sensor exceeds the second threshold value.

3. The image forming apparatus according to claim 2, wherein the temperature sensor is arranged inside a duct extending from the fan's side to the image carrier's side.

4. The image forming apparatus according to claim 2, wherein the temperature sensor is arranged outside a duct extending from the fan's side to the image carrier's side.

5. An image forming apparatus comprising:

an image carrier carrying a toner image;

a charging member electrically charging the image carrier;

a transferring member transferring the toner image carried on the image carrier to a transferred body;

a first voltage applying part applying voltage to one of the charging member and transferring member;

a current measuring part measuring current flowing when the first voltage applying part applies the voltage to the one of the charging member and transferring member;

a fan introducing an outside air to the apparatus inside and blowing the outside air to the image carrier;

a cleaning member removing a toner from a surface of the image carrier;

a controlling part configured to carry out an aging operation rotating the image carrier and bringing the cleaning member in sliding contact with the surface of the image carrier before forming an image and to lengthen a running time of the aging operation in a case where the current value measured by the current measuring part is equal to or less than a first threshold value when the fan blows the outside air to the image carrier and the first voltage applying part applies the voltage to the one of the charging member and transferring member, in comparison with another case where the current value measured by the current measuring part exceeds the first threshold value; and a second voltage applying part applying voltage to other of the charging member and transferring member; wherein the controlling part increases the voltage applied to the charging member for forming the image and decreases the voltage applied to the transferring member for forming the image, in a case where the current value measured by the current measuring part is equal to or less than a first standard value when the fan blows the outside air to the image carrier and the first voltage applying part applies the voltage to the one of the charging member and transferring member, in comparison with another case where the current value measured by the current measuring part exceeds the first standard value.

6. An image forming apparatus comprising:

an image carrier carrying a toner image;

a charging member electrically charging the image carrier;

a transferring member transferring the toner image carried on the image carrier to a transferred body;

a first voltage applying part applying voltage to one of the charging member and transferring member;

a current measuring part measuring current flowing when the first voltage applying part applies the voltage to the one of the charging member and transferring member;

a fan introducing an outside air to the apparatus inside and blowing the outside air to the image carrier;

a cleaning member removing a toner from a surface of the image carrier;

a controlling part configured to carry out an aging operation rotating the image carrier and bringing the cleaning member in sliding contact with the surface of the image carrier before forming an image and to lengthen a running time of the aging operation in a case where the current value measured by the current measuring part is equal to or less than a first threshold value when the fan blows the outside air to the image carrier and the first voltage applying part applies the voltage to the one of the charging member and transferring member, in comparison with another case where the current value measured by the current measuring part exceeds the first threshold value;

a developing member supplying the toner to the image carrier; and a bias applying part applying bias to the developing member, wherein the controlling part increases a duty ratio of the bias applied to the developing member for forming the image, in a case where the current value measured by the current measuring part is equal to or less than a second standard value when the fan blows the outside air to the image carrier and the first voltage applying part applies the voltage to the one of the charging member and transferring member, in comparison with another case where the current value measured by the current measuring part exceeds the second standard value.

7. The image forming apparatus according to claim 6, wherein the developing member supplies the toner to the image carrier during the aging operation.

8. The image forming apparatus according to claim 1, wherein the first voltage applying part applies the voltage to the charging member during the aging operation.

9. The image forming apparatus according to claim 1, wherein the image carrier is composed of a monolayer organic photoreceptor containing a charge generating agent and a charge transport agent in the same layer.

* * * * *